United States Patent [19]

Roth, deceased et al.

[11] 4,413,942

[45] Nov. 8, 1983

[54] LIFT-TYPE CAR PARK

[75] Inventors: Anton Roth, deceased, late of Hanau am Main, Fed. Rep. of Germany; by Guenther Moeller, executor, Wuelfrath, Fed. Rep. of Germany

[73] Assignee: Mercator Gesellschaft fur Entwicklung und Technik mbH, Dreieich, Fed. Rep. of Germany

[21] Appl. No.: 428,943

[22] Filed: Sep. 30, 1982

Related U.S. Application Data

[63] Continuation of Ser. No. 133,411, Mar. 24, 1980, abandoned.

[30] Foreign Application Priority Data

Mar. 22, 1979 [DE] Fed. Rep. of Germany ..... 2911182

[51] Int. Cl.[3] ..... E04H 6/00

[52] U.S. Cl. ..... 414/253; 414/259

[58] Field of Search ..... 414/227, 241–244, 414/253, 259, 260, 264

[56] References Cited

U.S. PATENT DOCUMENTS

| | | | |
|---|---|---|---|
| 2,890,802 | 6/1959 | Alimanestiano | 414/254 |
| 2,899,087 | 8/1959 | Jacobsen | 414/253 |
| 2,970,549 | 2/1961 | Volk et al. | 414/253 |
| 3,102,645 | 9/1963 | Roth | 414/259 |
| 3,497,087 | 2/1970 | Vita | 414/254 |
| 3,710,957 | 1/1973 | Small | 414/253 |

FOREIGN PATENT DOCUMENTS

| | | | |
|---|---|---|---|
| 283793 | 8/1965 | Australia | 414/259 |
| 659557 | 5/1965 | Belgium | 414/254 |
| 1126584 | 3/1962 | Fed. Rep. of Germany | 414/254 |
| 1271368 | 6/1968 | Fed. Rep. of Germany | 414/259 |
| 2257970 | 5/1974 | Fed. Rep. of Germany | 414/255 |
| 953680 | 3/1964 | United Kingdom | 414/259 |

*Primary Examiner*—Trygve M. Blix
*Assistant Examiner*—R. B. Johnson
*Attorney, Agent, or Firm*—Schwartz, Jeffery, Schwaab, Mack, Blumenthal & Koch

[57] ABSTRACT

Disclosed is a lift-type car park for removably storing a plurality of wheeled motor vehicles. The lift platform has a telescoping transport device mounted thereon. The lift platform can be brought level with a transfer area and the telescoping transport device can be extended adjacent the wheels of the motor vehicle to be parked. Guide rollers can then be swung out from the telescoping transport device to movably engage the wheel such that when the telescopic transport device is retracted onto the platform the motor vehicle is pulled onto the lift platform as well. The lift platform can then be moved to any one of a number of storage locations and the reverse operation takes place in which the motor vehicle is placed in a storage space. As a safety feature, in the area where a car is initially picked up prior to storage or deposited after storage, the telescoping transport device extends into a tunnel which serves as a walkway for vehicle occupants protecting them from the telescoping transport device and the guide rollers mounted thereon.

4 Claims, 3 Drawing Figures

LIFT-TYPE CAR PARK

CROSS-REFERENCE TO RELATED APPLICATION

This is a continuation, of application Ser. No. 133,411, filed Mar. 24, 1980, now abandoned.

BACKGROUND OF THE INVENTION

The present invention is generally related to lift-type car parks.

Known lift-type car parks have a lifting platform and a plurality of parking places for motor vehicles disposed over and next to one another in a vertical and horizontal storage arrangement.

Such a lift-type car park is shown for example in West German Auslegeschrift No. 11 30 994 and West German Patentschrift No. 17 09 343. In these lift-type car parks, the vehicles are moved from the lift to the parking place (and vice versa) with the aid of a shunting car which is equipped with lateral drive rollers enabling one wheel of the vehicle to be grasped from outside so that the vehicle can be moved horizontally, rolling on its own wheels. In addition to the shunting car, the parking place on ground level which serves as an entrance or an exit is provided with a revolving belt or chain, that may be moved in either direction. The revolving belt or chain, in the area of the "tow-path" will pick up the rear wheel of a motor vehicle to be parked which is standing on the belt or chain. The belt or chain carries two drive rollers or support elements that may be raised or lowered in any desired order to bear against the rear wheel.

Such conveying systems are relatively costly and have to be disposed so that they can be lowered in the parking places which also serve as the entrance or exit to the car park so as not to interfere with the normal ingress or egress to the area.

Furthermore, special driving systems are necessary, which should be electrically coupled to the entire system and need to be electronically controlled. Since these transporting systems must operate in areas which are accessible by the vehicle's occupants, they either need to be made safe or must be operated only when the occupants of a vehicle have vacated the vehicle and the area of the parking place. For safety purposes, the vehicle's occupants should only have access to the parking place when the transporting device has completed its delivery of the vehicle and is in its static or retracted position.

These requirements not only make the entire installation more expensive than would otherwise be the case but also slows down parking and collection operations. The time delay in the parking and collection operation alone makes itself very apparent, in a particularly disadvantageous fashion, at hours of peak usage.

SUMMARY OF THE INVENTION

It is an object of the present invention to provide a lift-type car park which does not require the expensive conveying systems needed in the prior art.

It is a further object of the present invention to simplify the installation of a lift-type car park and to render the entrance and exit area safe for any vehicle occupants.

It is a still further object of the present invention to speed up the operation of parking and collecting cars in a lift-type car park.

The above and other objects are achieved by providing a lift-type car park with a lift platform and a plurality of parking places for motor vehicles which places are located over and next to one another in a vertical and/or horizontal array. The vehicles to be parked are moved horizontally by rolling on their own wheels with the aid of a telescopic means for transporting the cars which is located on the vertical lift platform. The telescopic means is extendable and retractable into a tunnel which is located at the transfer point (the point at which the car is left for parking or collection). The telescopic means may be extended into the tunnel at any time even when the vehicle occupants are still inside the vehicle, (during the parking operation for example) with complete safety. The telescopic means, the operation of which is controlled from the lift platform, may be extended when the lift platform has reached the level of the transfer point without the vehicle occupants or other persons being endangered.

The telescopic means for transporting may have gripping and guiding means which can be swung out or retracted sideways through a slot-shaped aperture in the tunnel which is aligned with the side of the vehicle. In one embodiment, these may have at least two driving rollers which, when the telescopic means is extended, can be swung out from their static or retracted position (in which they lie parallel to the longitudinal axis of the vehicle) through substantially 90°, in opposite directions, until they meet the vehicle wheel grasping it at a level below its axis of rotation. To facilitate transportation into the lift-type car park, the motor vehicle is first parked with its wheels close to the tunnel. Special markings may be provided to assure that the vehicle is correctly positioned. Such markings may be flat guide rails with shallow recesses in the ground into which a wheel may be driven. When parking a vehicle close to the tunnel, the telescopic transporting arrangement may already be in the tunnel, with the drive rollers remaining in their static or retracted attitude. Once the vehicle has reached its transfer point, the operation of swinging out the driving rollers to their extended position for grasping one wheel of the vehicle can take place with the aid of a control signal.

At the transfer point the tunnel is provided with an opening in its front end facing the lift for extension and retraction of the telescopic transporting arrangement. All the openings in the tunnel are preferably fitted with suitable curtains, flaps or shutters for automatic closure and opening. This measure prevents the ingress of dirt or, in winter, snow and ice into the tunnel so that this precludes any hindrance to movement of the telescopic transporting arrangement.

The outer surface of the tunnel, in a further embodiment, may be formed as a standing area for the occupants of the vehicle to get in and out, and this can be covered with a non-slip surface. These features increase the safety of the occupants of the vehicle.

Since the vehicle occupants can get in or out at any time regardless of the attitude of the telescopic transporting arrangement, the time taken to process a vehicle and thus the vehicle turnover as a whole is appreciably improved in such a lift-type car park. But the measures in accordance with the invention also simplify the transporting arrangements so that the entire installation also becomes less expensive.

BRIEF DESCRIPTION OF THE DRAWINGS

A more complete appreciation of the invention and the attendant advantages thereof will be more clearly understood by reference to the following drawings wherein.

DETAILED DESCRIPTION OF PREFERRED EMBODIMENTS

Figure 1:
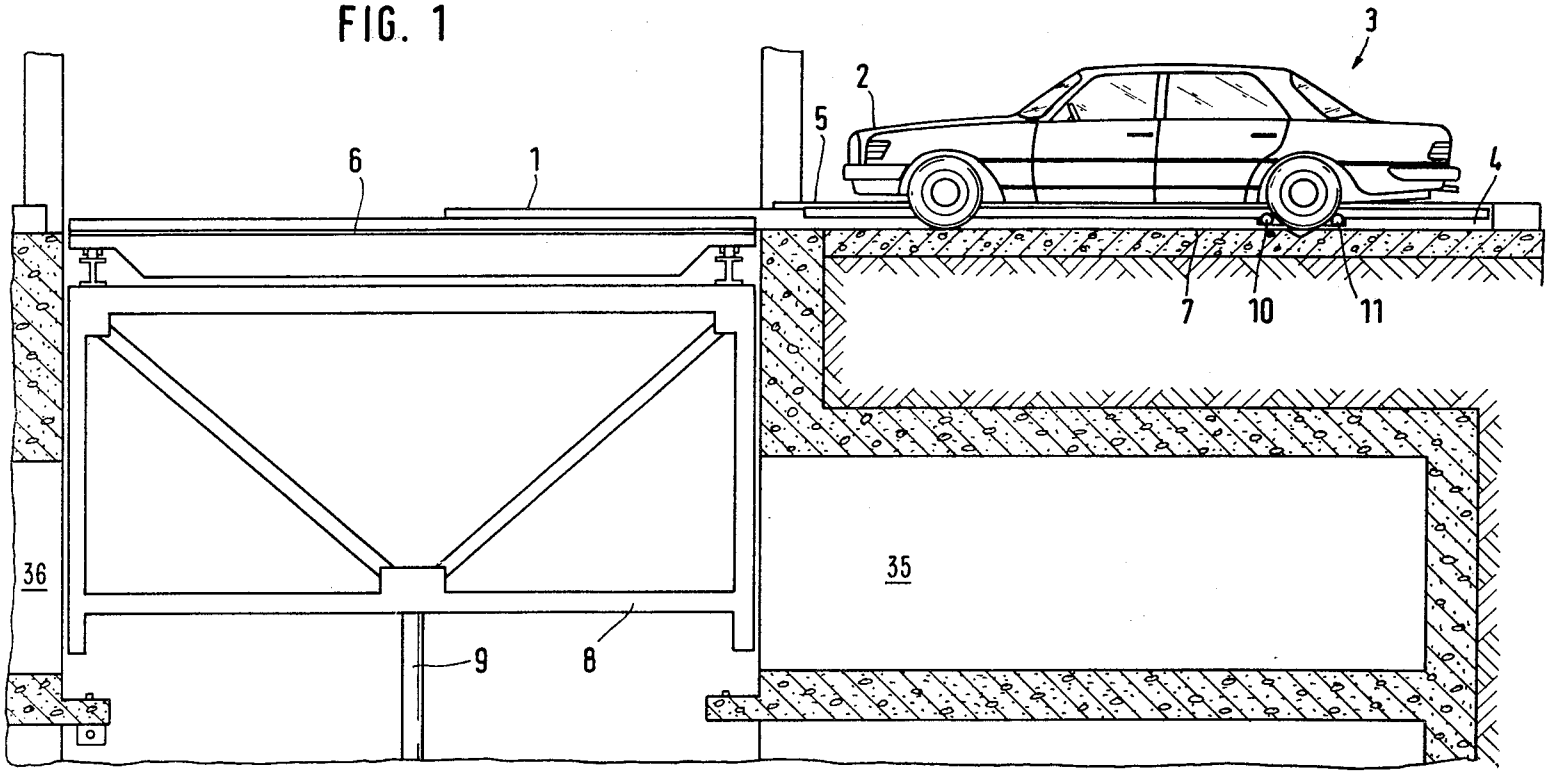
FIG. 1 is a side view partially in cross-section of a lift-type car park with the lift platform level with the transfer point.

Referring now to the drawings wherein like reference characters designate like parts throughout the several views, FIG. 1 shows the lift platform 6 to be level with floor 7 at a transfer point 3, and the telescopic means for transporting 1 is illustrated in its extended state. The lift platform 6 is carried by a lift framework 8 which can be raised and lowered by a hydraulic cylinder 9 by means of a hydraulic system (not shown in detail). A motor vehicle 2 is at the transfer position and the telescopic transporting arrangement is extended into the tunnel 5. The tunnel 5 is provided with a lateral opening 4 so that gripping and guiding means 10 and 11 can be swung out from the telescopic means.

Figure 2:
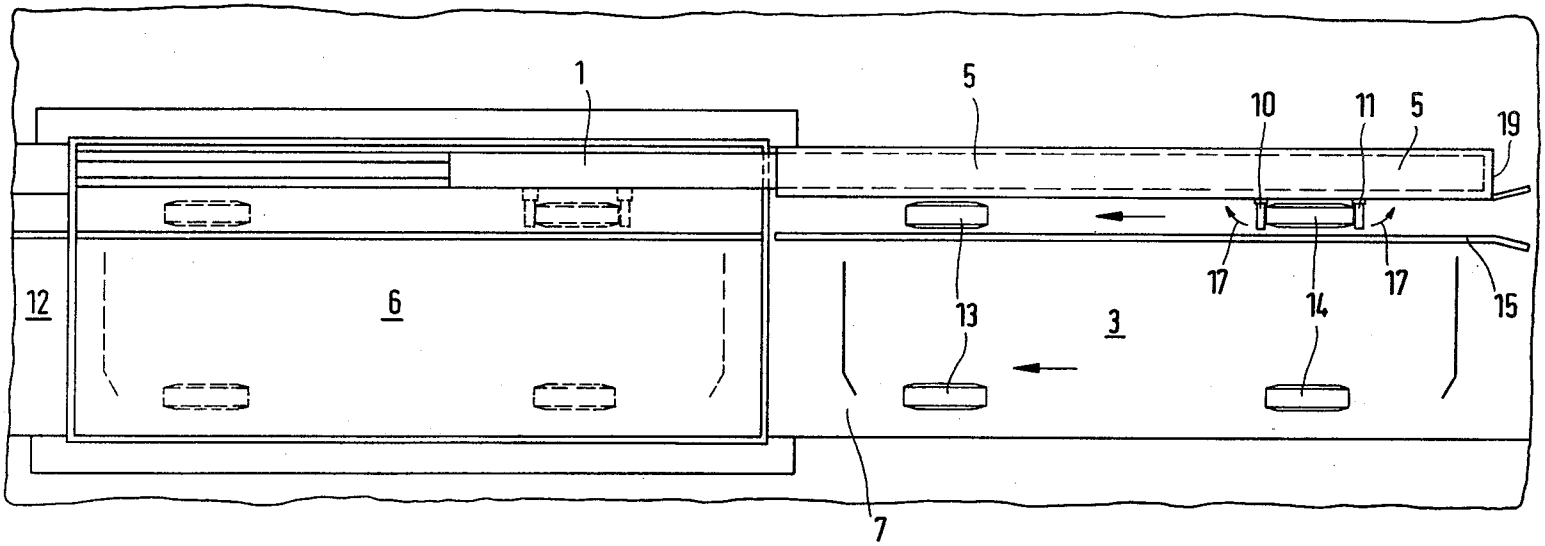
FIG. 2 is a plan view of the lift platform and transfer point shown in FIG. 1.

FIG. 2 is a plan view of the lift platform 6 in the position corresponding to that shown in FIG. 1. The telescopic means 1 can be extended and retracted in the longitudinal direction from the platform 6 so that a vehicle can be picked up from the transfer point 3, for example, and, at the end of the parking period, delivered automatically to a transfer point 12 on the exit side of the installation.

In FIG. 2 the motor vehicle in the transfer position has wheels 13 and 14. To facilitate positioning the motor vehicle, there is a wheel guide 15 near the tunnel 5, the upper part of guide 15 (see FIG. 3) may be provided with a rubber cover 16 or the like to prevent damage to the wheels of the motor vehicle and facilitate guidance thereof.

In FIG. 2 the gripping and guiding means 10 and 11 of the telescopic means are shown in their extended state, the arrows 17 indicating the directions of movement during extension.

A transfer operation for parking a motor vehicle proceeds as follows. A motor vehicle is left at the transfer point 3 (in the position shown in FIG. 2) with its brakes off and its transmission in neutral. The vehicle occupants then leave the vehicle via the doors on either side of it. The platform 6 is brought level with the floor 7 of the transfer point 3 by an automatic control system (not shown) and the door 18 of the lift-type car park is opened. The telescopic transporting means is extended by a extension mechanism into tunnel 5 until it reaches stop 19. When a corresponding signal is given (which may be effected by means of sensors or photoelectric cells for example) the presence of a motor vehicle at the transfer point 3 is verified. If this signal is affirmative, the gripping and guiding means 10 and 11, formed as drive rollers in the preferred embodiment, are swung out by an extension and retraction means until they rest against the surface of a wheel 14 of the motor vehicle (as shown in FIG. 2). Then the telescopic means is retracted and draws the motor vehicle onto the lift platform 6. Once the vehicle is on platform 6 door 18 closes and the lift platform 6 seeks a parking space under automatic control. This space may be located in front of or behind the platform as shown at 35 and 36, respectively, in FIG. 1, since the telescopic means is designed to move in either direction. After the vehicle has been rolled off the platform 6 with the aid of the telescopic means, the gripping and guiding devices 10 and 11 retract to their resting attitude and the telescopic transporting means 1 retracts onto the lift platform 6. A parked vehicle is moved from its parking place onto the lift platform and transported to a transfer point 3 or 12 for collection in an essentially similar fashion.

As only the lift car park operating staff can gain access to the parking places in the lift-type car park, it is not necessary to provide tunnels for the safe guidance of the telescopic means therein.

Figure 3:
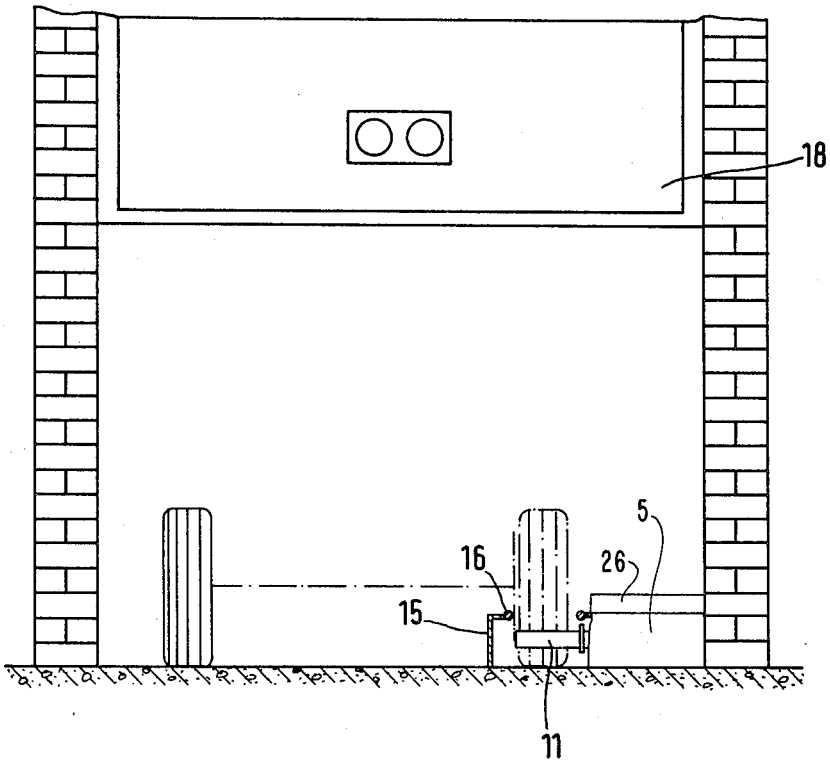
FIG. 3 is an end view partially in section of the telescopic means for transporting in its extended state.

Preferably the tunnel 5 is of steel plate, as is the wheel guide 15 disposed parallel with the tunnel. Naturally the wheel guide 15 may be made of concrete or a similar material and can be made very low as shown in FIG. 3.

Depending upon local conditions, the tunnel 5 may be open at its side all the time. However, to prevent dirt, ice or snow getting in, it is expedient to make it closable by means of curtain or by shutters or flaps which can be opened before the gripping and guiding devices 10 and 11 are extended and closed after they have been retracted.

The tunnel 5 may be provided as a step onto which the vehicle occupants may alight from the vehicle, or enter the vehicle. In these circumstances although not shown in FIGS. 1 and 2, it may be desirable that the outer surface of the tunnel is provided with a non-slip surface, for example a rubber tread 26, shown in FIG. 3.

Although the invention has been described relative to a specific embodiment thereof, it is not so limited and many modifications and variations thereof will be readily apparent to those skilled in the art in light of the above teachings. It is, therefore, to be understood that, within the scope of the appended claims, the invention may be practiced otherwise than as specifically described.

The embodiments of the invention in which an exclusive property or privilege is claimed are defined as follows:

1. A lift type car park for removably storing a plurality of wheeled vehicles, said car park having:

an entrance; at least one transfer location at said entrance, said entrance transfer location including a floor for supporting wheeled vehicles; a plurality of parking spaces disposed on levels spaced vertically from said entrance transfer location floor;

at least one movable platform means which can be aligned with said floor and each of said levels for transporting motor vehicles from said entrance transfer location to said levels;

said entrance transfer location having a vehicle position and a passenger entry and exit position alongside said vehicle position to permit passengers to enter and exit a vehicle in said vehicle position;

a tunnel member mounted to and rising above said floor in said vehicle entry and exit position, said tunnel member having a slot shaped aperture disposed in a side of said tunnel facing said vehicle position and aligned with the horizontal direction of transport of said motor vehicle, said tunnel member having a substantially flat continuous upper surface above said aperture for supporting passengers entering and exiting a vehicle, said tunnel member having an entry opening facing said platform means;

telescopic means mounted on said platform, said telescopic means being movable from a retracted position in which said telescopic means is completely received on said platform to an extended position; said tunnel member being aligned with said telescopic means when said platform is aligned with said floor such that said telescopic means is received in said tunnel through said entry opening when in the extended position;

guiding and gripping means extendable through said slot shaped opening and connected to said telescopic means for removably engaging at least one wheel of said motor vehicle at a position above said floor and rolling said vehicle along said floor on its own wheels onto said platform when said telescopic means is moved from said extended position to said retracted position; and wheel guide means disposed adjacent tunnel member for guiding the wheel of said vehicle as it moves along said floor.

2. The lift type car park of claim 1 where each of said parking places includes an open, exposed area into which said telescopic means extends with said guiding and gripping means to move a vehicle thereto or remove a vehicle therefrom.

3. The lift type car park of claim 1 wherein said tunnel upper surface includes a non-slip covering.

4. The lift type car park of claim 1 wherein said guiding and gripping means comprises at least two drive rollers pivotable through a substantially 90° arc for engaging a wheel below the axis of rotation of said wheel.

* * * * *